US006582216B2

(12) United States Patent
Kosman

(10) Patent No.: US 6,582,216 B2
(45) Date of Patent: Jun. 24, 2003

(54) MOULD CONTAINER WITH EXCHANGEABLE MOULD CONTAINER PART

(75) Inventor: Wilhelmus Jacobus Maria Kosman, Groesbeek (NL)

(73) Assignee: Beheermaatschappij de Boer Nijmegen B.V., Nijmegen (NL)

( * ) Notice: Subject to any disclaimer, the term of this patent is extended or adjusted under 35 U.S.C. 154(b) by 115 days.

(21) Appl. No.: 09/775,186

(22) Filed: Feb. 1, 2001

(65) Prior Publication Data

US 2001/0016217 A1 Aug. 23, 2001

(30) Foreign Application Priority Data

Feb. 2, 2000 (NL) ..... 1014262

(51) Int. Cl.[7] ..... B28B 5/02; B28B 7/10

(52) U.S. Cl. ..... 425/183; 425/195; 425/255; 425/444; 425/261; 249/102

(58) Field of Search ..... 435/183, 195, 435/220, 255, 357, 443, 444, 452, 261; 249/102; 264/297.9

(56) References Cited

U.S. PATENT DOCUMENTS 4,836,762 A * 6/1989 Davis, Jr. ..... 425/112
5,612,064 A * 3/1997 Kosman ..... 264/297.7
5,648,009 A * 7/1997 Johnston ..... 249/129

* cited by examiner

*Primary Examiner*—James P. Mackey
*Assistant Examiner*—Donald Heckenberg
(74) *Attorney, Agent, or Firm*—Webb Ziesenheim Logsdon Orkin & Hanson, P.C.

(57) ABSTRACT

The invention relates to a mould container for an apparatus for manufacturing green bricks from clay for the brick manufacturing industry, wherein mould containers are arranged on a circulating conveyor, which mould containers comprise a number of mould cavities open to the top, wherein the mould container comprises a fixed mould container part with mould cavities and an exchangeable mould container part such that green bricks of differing dimensions can be made simultaneously.

14 Claims, 4 Drawing Sheets

MOULD CONTAINER WITH EXCHANGEABLE MOULD CONTAINER PART

BACKGROUND OF THE INVENTION

1. Field of the Invention

The invention relates to a mould container for an apparatus for manufacturing the green bricks from clay for the brick manufacturing industry, wherein mould containers are arranged on a circulating conveyor, which mould containers comprise a number of mould cavities open to the top.

2. Description of the Prior Art

Such mould containers are known for instance from NL-C-1000186.

The mould containers are especially manufactured for one shape of green brick. Large quantities of green bricks of the same shape can thus be produced.

In particular cases it is desired to be able to make a small batch of green bricks, wherein the shape of the green bricks differs from the shape defined by the mould containers. In order to enable manufacture of such a small batch, new mould containers have to be manufactured which are then mounted in the apparatus. In addition to the high cost of manufacturing the mould containers, loss also occurs in converting the apparatus from the one type of mould container to the other type of mould container.

It is an object of the invention to obviate the above stated drawbacks.

SUMMARY OF THE INVENTION

This objective is achieved according to the invention in that the mould container comprises a fixed mould container part with mould cavities and an exchangeable mould container part. In such a mould container the fixed mould container part remains mounted on the conveyor, while the exchangeable mould container part can simply be replaced, whereby it becomes possible to provide a number of mould cavities of different dimensions in the mould container. Green bricks of a standard size are thus formed during production by the fixed mould container part, while the exchangeable mould container part can manufacture bricks of any desired shape.

The exchangeable mould container part preferably comprises at least one mould cavity open to the top. This mould cavity defines the shape of the desired green bricks for the small batch.

In another embodiment the exchangeable mould container part comprises a bottom movable in the mould cavity. The bottom is adapted to the form of the mould cavity and can thus push out the green brick formed in the mould cavity.

In yet another embodiment according to the invention the exchangeable mould container part comprises a closed upper surface. In particular cases it is desired not to provide all mould containers with an exchangeable mould container part of different shape, because the desired batch is for instance very small or because the production speed of this differing batch is otherwise too high. By now providing some mould containers with an exchangeable mould container part with closed upper surface, no green bricks of different shape will be formed in these mould containers.

The invention further comprises an apparatus for manufacturing green bricks from clay for the brick manufacturing industry, which apparatus comprises:

a circulating conveyor carrying mould containers, wherein the mould containers each comprise a number of mould cavities open to the top;

a filling device placed above the chain for filling the mould cavities with clay; and a grid plate placed between the filling device and the chain for guiding the clay into the mould cavities, which is characterized in that the mould containers comprise at least one mould container according to the invention.

In such an apparatus the grid plate ensures that the flow of clay is such that the mould cavity is wholly filled. When the mould container parts are now exchanged, the grid plate then also has to be modified, so that the flow of clay is also properly guided into the mould cavities of modified shape.

In a preferred embodiment of the apparatus according to the invention the grid plate comprises an exchangeable grid part. The whole grid plate does not hereby need to be exchanged when the mould container parts are exchanged, but only a part of the grid plate need be exchanged.

These and other features of the invention are further elucidated with reference to the annexed drawings.

DETAILED DESCRIPTION OF THE PREFERRED EMBODIMENTS

Figures 1, 2:
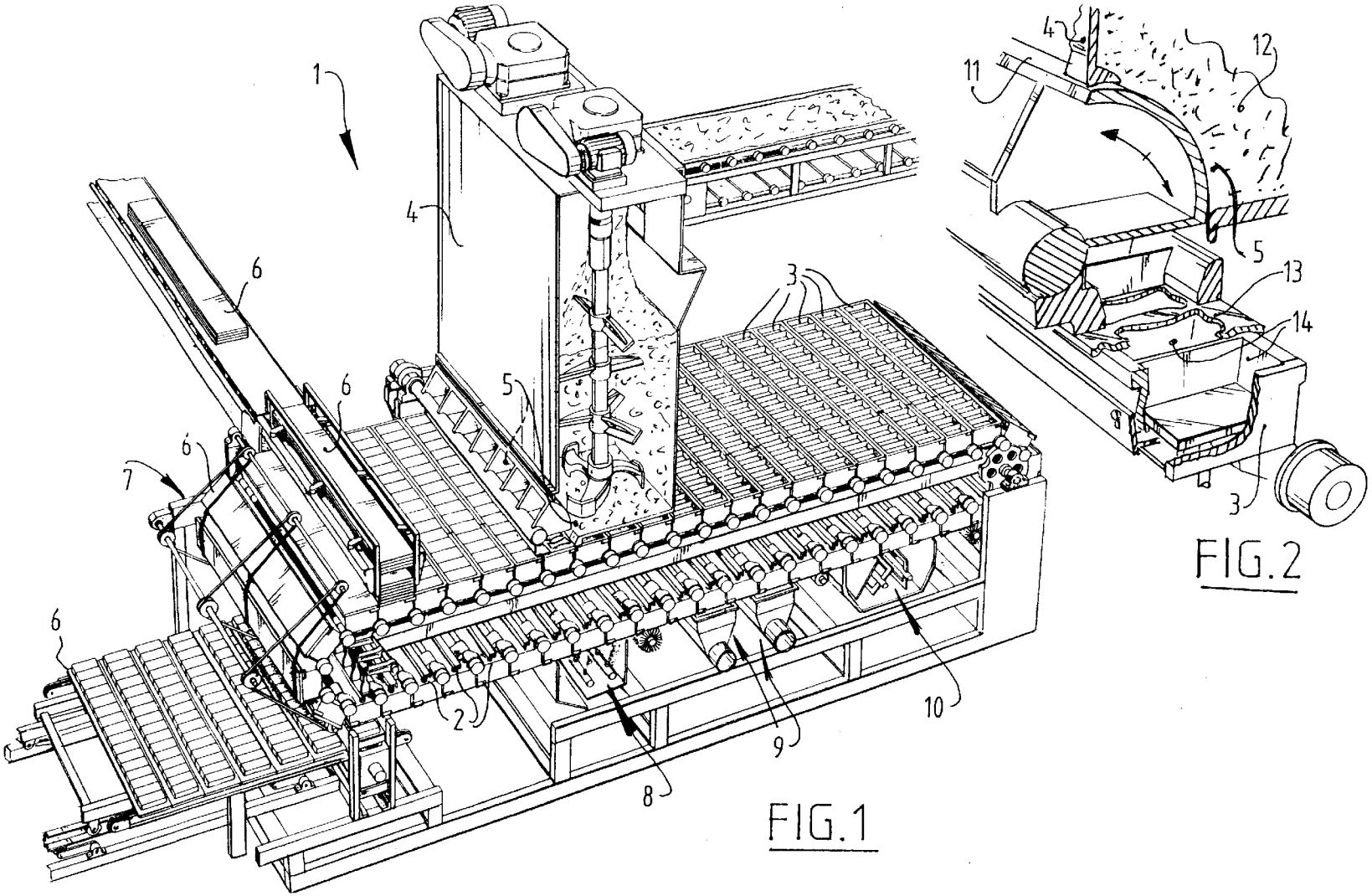
FIG. 1 is a perspective view of an apparatus according to the invention.
FIG. 2 is a perspective view with cut-away parts of the apparatus according to FIG. 1.

FIG. 1 describes in perspective view an apparatus 1 for manufacturing green bricks from clay for the brick manufacturing industry. This apparatus comprises a conveyor 2 on which mould containers 3 are arranged. A reservoir 4 for clay 3 is arranged above mould containers. Reservoir 4 has an outlet opening 5 along which the mould containers 3 are filled.

When mould containers 3 are filled with clay, planks 6 are then placed on mould containers 3, whereafter mould container with plank is turned over in device 7. The clay is then pushed out of mould containers 3 and the planks 6 having the formed green bricks thereon are transported further. The mould containers are then cleaned by a washing device 8, dried by a drying device 9 and once again provided with a layer of sand by means of a sand-covering device 10, whereafter mould containers 3 can again be filled with clay.

FIG. 2 shows outlet opening 5 of reservoir 4 in perspective view and with cut-away parts. As soon as a mould container 3 has been transported under outlet opening 5, the flap 11 is then opened whereby clay 12 can flow via grid plate 13 into mould cavities 14.

Figure 3:
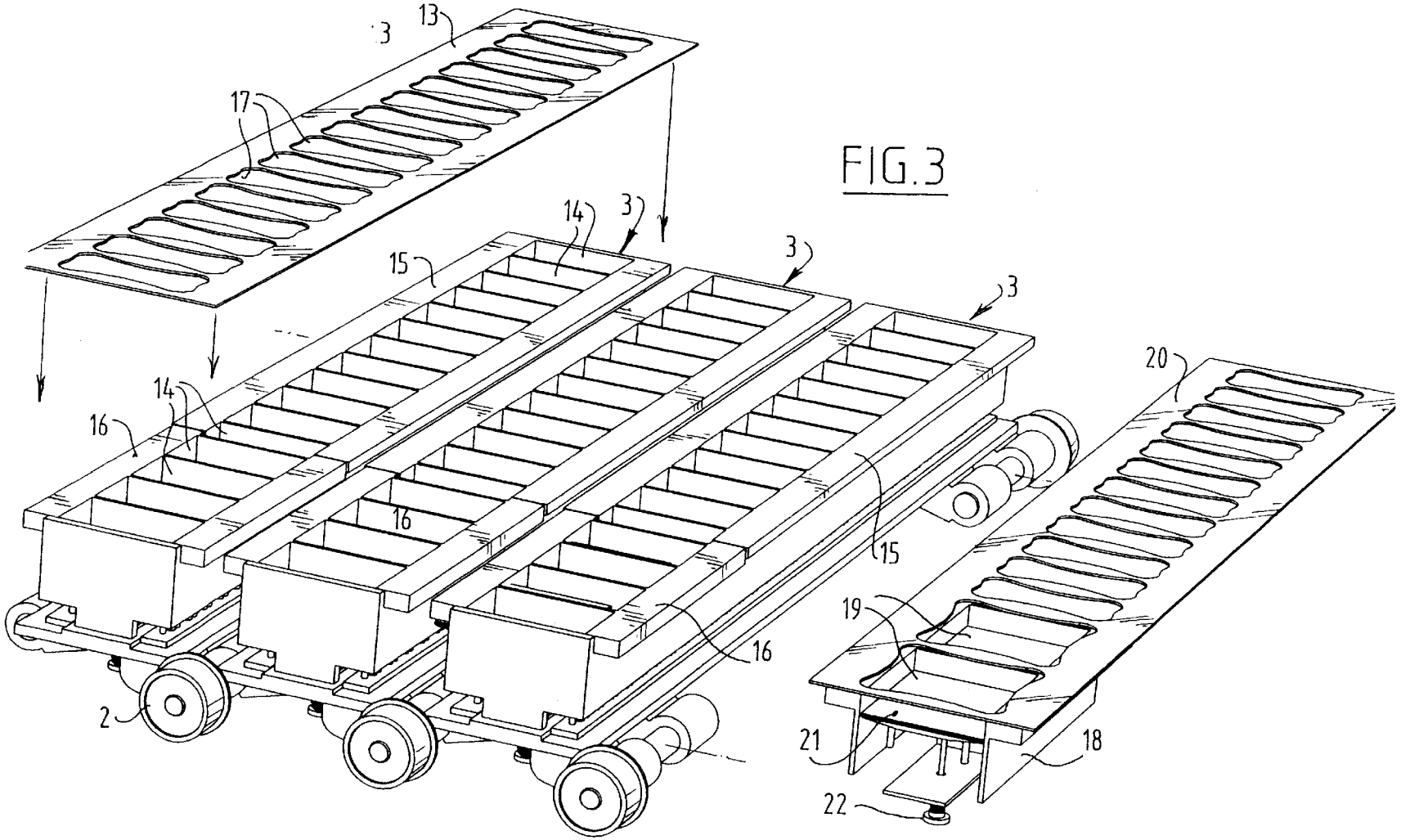
FIG. 3 is a perspective view of a number of mould containers according to the invention arranged on a conveyor.

FIG. 3 shows a number of mutually adjacent mould containers 3 which are arranged on conveyor 2. Each mould container 3 comprises a fixed part 15 with mould cavities 14 and an exchangeable part 16, which in this embodiment also has mould cavities 14. Grid plate 13 has openings 17 corresponding with mould cavities 14 in mould containers 3.

Further shown in FIG. 3 is a second exchangeable part 18 which has two different mould cavities 19. Also shown is a second grid plate 20, the openings of which correspond with the mould cavities of the second exchangeable part 18.

The exchangeable part 18 has movable bottoms 21 which can be operated by means of an ejector 22.

Figure 4:
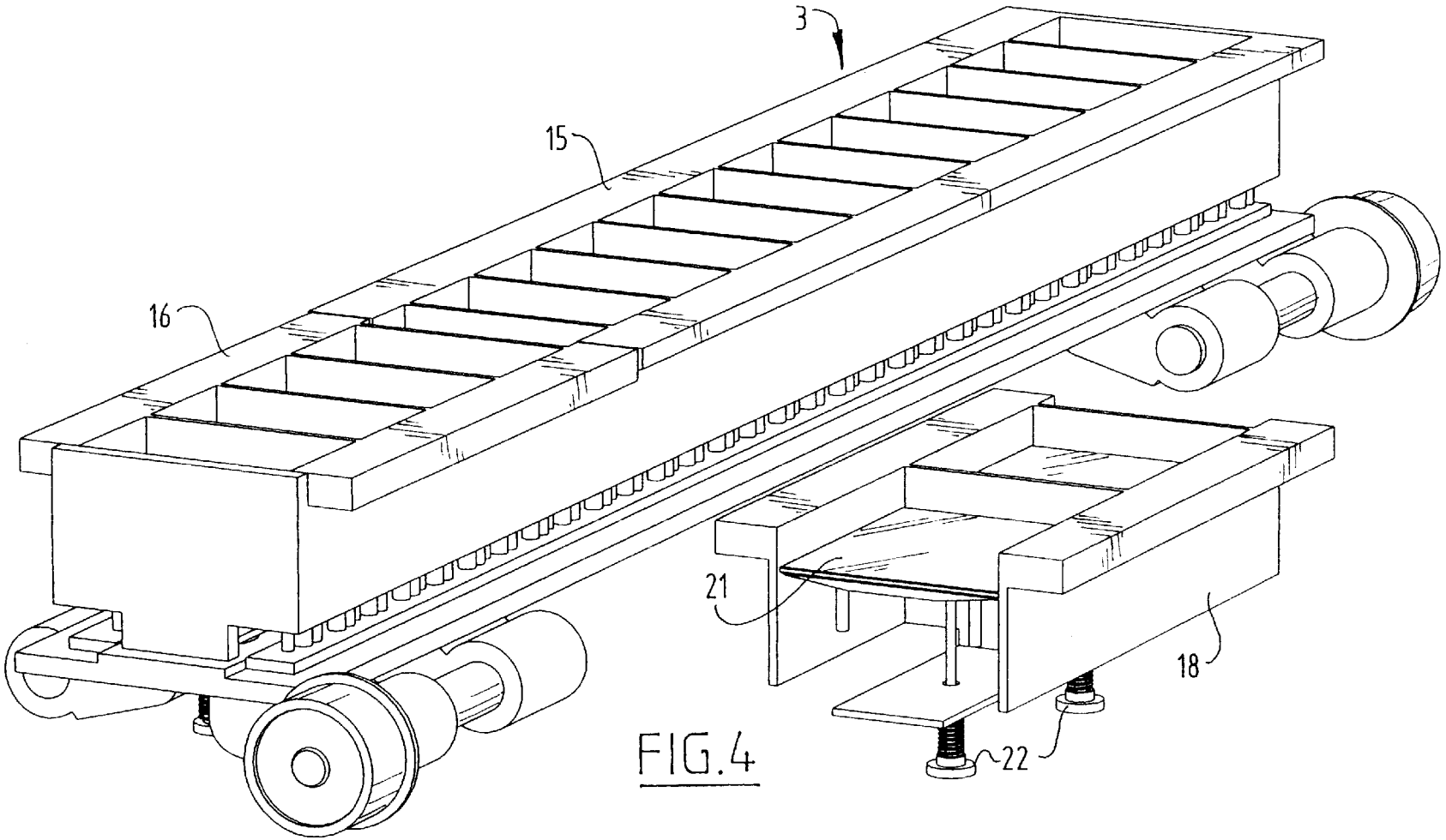
FIG. 4 is a perspective view of a mould container according to the invention and an exchangeable mould container part.

FIG. 4 shows from another viewpoint the mould container 3 with fixed part 15 and exchangeable part 16, in addition to a second exchangeable part 18.

Figure 5:
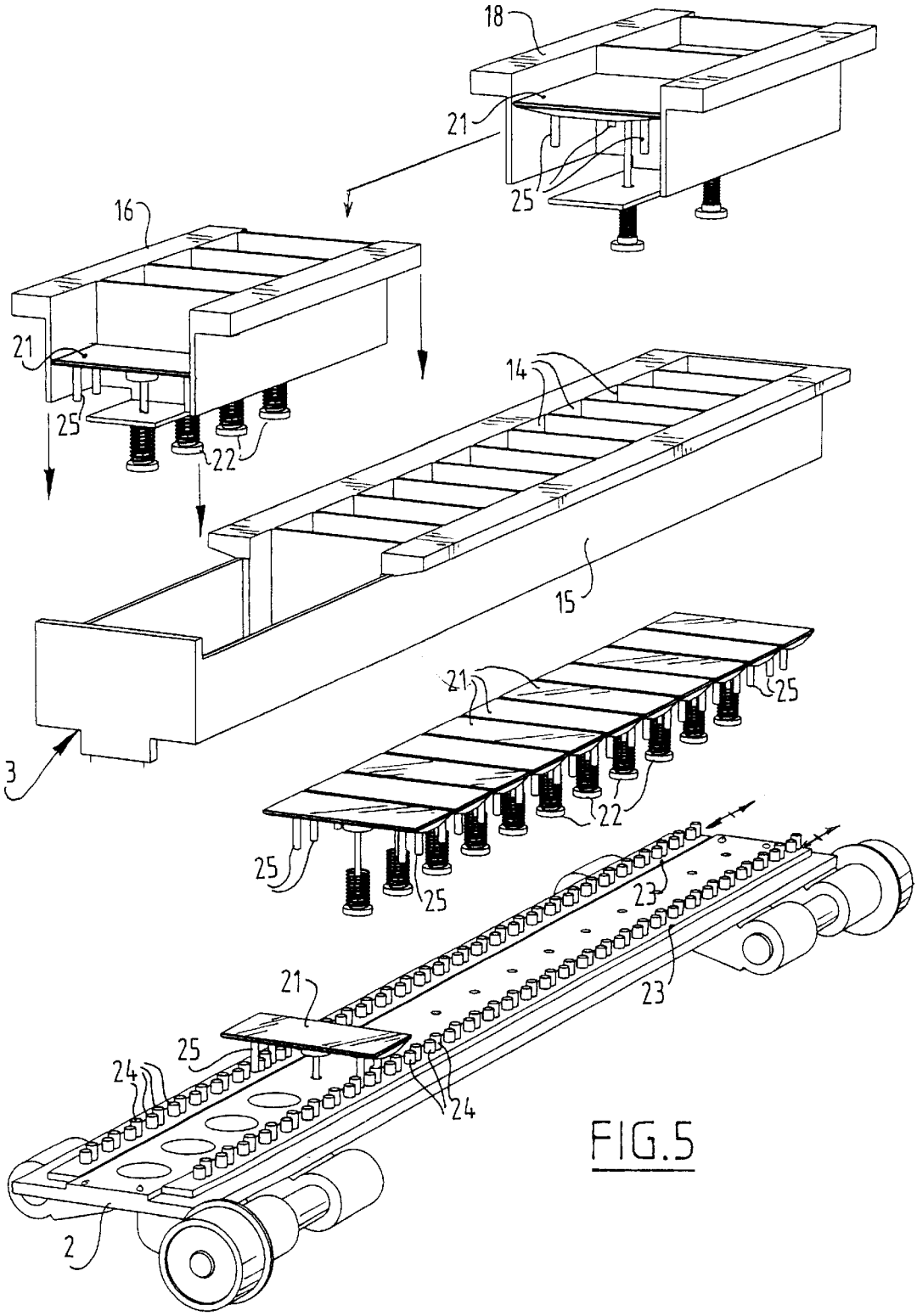
FIG. 5 is a perspective view of the mould container of FIG. 4 with exploded parts.

FIG. 5 shows a perspective view with exploded parts of a mould container 3 according to the invention. This mould container 3 consists of the fixed part 15 in which mould cavities 14 are defined and exchangeable parts 16 respectively 18. The fixed part 15 of mould container 3 is mounted fixedly on conveyor 2. Movable bottoms 21, which can be operated by ejectors 22, are herein arranged fixedly in conveyor 2 with the fixed part 15 and arranged in this part with exchangeable part 16 respectively 18. Two strips 23 which are slidable in the length are arranged on the conveyor. Studs 24 of differing height are arranged on these strips. Further arranged on the underside of movable bottoms 21 are legs 25 which limit the stroke of the movable bottom and thus define the depth of mould cavity 14. By now sliding the movable strips 23 the legs 25 will be able to lie on the different studs 24, whereby the depth of mould cavities 14, and therefore the height of the green bricks, can be adjusted.

Although not shown in the drawings, it is possible to place a closed exchangeable part in the fixed part 15 of mould container 3, so that no green bricks are formed at the position of this closed exchangeable part. The production speed of the differing batch can hereby be modified. It hereby becomes possible to make the production time for the differing batch the same as the production time for the standard batch.

What is claimed is:

1. A mould container adapted to be arranged upon a circular conveyor on an apparatus for manufacturing green bricks from clay, wherein the mould container includes a number of mould cavities open to a top, the mould container comprising a fixed mould container part with mould cavities and an exchangeable mould container part with mould cavities, wherein the exchangeable to mould container part includes a bottom movable in at least one mould cavity and a plurality of adjustable legs for limiting the stroke of the movable bottom thereby defining the depth of the at least one mould cavity of the exchangeable mould container part.

2. The mould container as claimed in claim 1, wherein the exchangeable mould container part includes a least one mould cavity open to the top.

3. The mould container as claimed in claim 1, wherein the exchangeable mould container part includes a closed upper surface.

4. An apparatus for manufacturing green bricks from clay for the brick manufacturing industry, comprising:

a circulating conveyor carrying mould containers, wherein the mould containers each include a number of mould cavities open to a top;

a filling device laced above the mould containers for filling the mould cavities with clay; and a grid plate placed between the filling device and the mould containers for guiding the clay into the mould cavities, wherein at least a mould container comprises a fixed mould container part with mould cavities and an exchangeable mould container part with mould cavities and wherein the exchangeable mould container part includes a bottom movable in at least one mould cavity and a plurality of adjustable legs for limiting the stroke of the to able bottom thereby defining the depth of the at least one mould cavity of the exchangeable mould container part.

5. The apparatus of claim 4, wherein the exchangeable mould container part includes at least one mould cavity open to the top.

6. The apparatus of claim 4, wherein the exchangeable mould container part includes a closed upper surface.

7. The apparatus as claimed in claim 4, wherein the grid plate comprises an exchangeable grid part.

8. The apparatus as claimed in claim 5, wherein the grid plate comprises an exchangeable grid part.

9. The apparatus as claimed in claim 6, wherein the grid plate comprises an exchangeable grid part.

10. An apparatus for manufacturing green bricks from clay for the brick manufacturing industry, comprising:

a circulating conveyor carrying mould containers, wherein the mould containers each include a number of mould cavities open to a top;

a filling device placed above the mould containers for filling the mould cavities with clay; and a grid plate placed between the filling device and the mould containers for guiding the clay into the mould cavities, wherein the grid plate comprises an exchangeable grid part, wherein at least one mould container comprises a fixed mould container part with mould cavities and an exchangeable mould container part.

11. A mould container adapted to be arranged upon a circular conveyor on an apparatus for manufacturing green bricks from clay, wherein the mould containers include a number of mould cavities op to a top, the mould container comprising a fixed mould container part with mould cavities and exchangeable mould container part with mould cavities, wherein the exchangeable mould container part include a bottom movable in each mould cavity of the exchangeable mould container of the exchangeable mould container part, wherein the movable bottom has studs of different heights, and wherein the studs define the lowermost positions of the movable bottoms thereby defining the volume of material each mould cavity of the exchangeable of the exchangeable mould container part may accept.

12. The mould container as claimed in claim 11, wherein the exchangeable mould container part includes at least one mould cavity open to the top.

13. The mould container as claimed in claim 11, wherein the exchangeable mould container part includes a closed upper surface.

14. An apparatus for manufacturing green bricks from clay for the brick manufacturing industry, comprising:

a circulating conveyor carrying mould containers, wherein the mould containers each include a number of mould cavities open to a top;

a filling device placed above the mould containers for filling the mould cavities with clay; and a grid plate placed between the filling device and the mould conveyors for guiding the clay into the mould cavities, wherein at least one mould container comprises a fixed mould container part with mould cavities and an exchangeable mould container part, with mould cavities, wherein the exchangeable mould container part includes a bottom movable in each mould cavity of the exchangeable mould container part, wherein the movable bottom has studs of different heights, an wherein the studs define the lowermost positions of the movable bottoms thereby defining the volume of material each mould cavity of the exchangeable mould container may accept.

* * * * *

UNITED STATES PATENT AND TRADEMARK OFFICE

CERTIFICATE OF CORRECTION

PATENT NO. : 6,582,216 B2 
DATED : June 24, 2003
INVENTOR(S) : Wilhelmus Jacobus Maria Kosman It is certified that error appears in the above-identified patent and that said Letters Patent is hereby corrected as shown below:

Column 4,
Line 4, “to able” should read -- movable --.
Line 36, “op” should read -- open --.
Line 39, “include” should read -- includes --.
Line 45, “of the exchangeable of the exchangeable” should read -- of the exchangeable --.
Line 65, “part,” should read -- part --.

Column 5,
Line 2, “an” should read -- and --.

Column 6,
Line 2, “container may” should read -- container part may --.

Signed and Sealed this

Seventh Day of October, 2003

JAMES E. ROGAN
*Director of the United States Patent and Trademark Office*